US008910429B2

(12) United States Patent
Maziarz

(10) Patent No.: US 8,910,429 B2
(45) Date of Patent: Dec. 16, 2014

(54) APPARATUS AND METHOD FOR INSTALLING FASTENERS TO SECURE FRAMING COMPONENTS

(71) Applicant: Michael W. Maziarz, Wilbraham, MA (US)

(72) Inventor: Michael W. Maziarz, Wilbraham, MA (US)

(73) Assignee: Handy & Harman, White Plains, NY (US)

( * ) Notice: Subject to any disclaimer, the term of this patent is extended or adjusted under 35 U.S.C. 154(b) by 0 days.

(21) Appl. No.: 13/963,605

(22) Filed: Aug. 9, 2013

(65) Prior Publication Data

US 2014/0047794 A1 Feb. 20, 2014

Related U.S. Application Data

(60) Provisional application No. 61/682,946, filed on Aug. 14, 2012.

(51) Int. Cl.

| | |
|---|---|
| ***E04B 7/04*** | (2006.01) |
| ***E04F 21/00*** | (2006.01) |
| ***E04B 7/00*** | (2006.01) |
| ***E04G 21/18*** | (2006.01) |

(52) U.S. Cl.

CPC . *E04F 21/00* (2013.01); *E04B 7/00* (2013.01); *E04G 21/1891* (2013.01); *Y10S 52/01* (2013.01)

USPC ..... 52/92.2; 52/93.2; 52/DIG. 1; 52/749.1; 33/613; 33/645

(58) Field of Classification Search

USPC ..... 52/91.1, 91.3, 92.2, 93.2, 749.1, DIG. 1; 33/404, 414, 416, 417, 613, 645, 33/646–649

See application file for complete search history.

(56) References Cited

U.S. PATENT DOCUMENTS

| | | | | | |
|---|---|---|---|---|---|
| 1,688,445 | A | * | 10/1928 | Williams | 81/44 |
| 2,744,332 | A | * | 5/1956 | Day | 33/416 |
| 4,676,424 | A | * | 6/1987 | Meador et al. | 227/147 |
| 4,930,225 | A | * | 6/1990 | Phillips | 33/526 |
| 4,965,980 | A | * | 10/1990 | Leavens | 52/712 |
| 5,071,280 | A | * | 12/1991 | Turner | 403/232.1 |
| 5,230,198 | A | * | 7/1993 | Callies | 52/702 |
| 5,497,593 | A | * | 3/1996 | Riesberg | 52/702 |
| 5,546,726 | A | * | 8/1996 | Stalzer | 52/702 |
| 5,603,580 | A | * | 2/1997 | Leek et al. | 403/232.1 |
| 6,726,155 | B1 | * | 4/2004 | Zimmerman | 248/48.1 |
| 7,788,873 | B2 | * | 9/2010 | Leek | 52/702 |
| 2009/0139153 | A1 | * | 6/2009 | Hudson | 52/92.2 |
| 2011/0167757 | A1 | * | 7/2011 | Vandenberg | 52/745.21 |
| 2013/0276591 | A1 | * | 10/2013 | Vandenberg | 81/57.37 |

* cited by examiner

*Primary Examiner* — Brian Glessner
*Assistant Examiner* — Joshua Ihezie
(74) *Attorney, Agent, or Firm* — Alix, Yale & Ristas, LLP

(57) ABSTRACT

A fastener installation guide for securing a top plate to a roof support member comprises a grip assembly, a roof support member alignment wall and a fastener retention assembly transverse to the grip assembly. The handle portion has first and second top plate alignment members oriented generally perpendicular to one another. A gripping surface extends between the first and second top plate alignment members and the roof support member alignment defines a first plane oriented transversely to the grip assembly. The fastener retention assembly defines a fastener retention channel and has a fastener alignment wall which defines a second plane, a roof support member alignment edge and a bottom edge. The fastener retention channel is oriented at an angle θ with respect to the second plane.

15 Claims, 8 Drawing Sheets

APPARATUS AND METHOD FOR INSTALLING FASTENERS TO SECURE FRAMING COMPONENTS

BACKGROUND OF THE DISCLOSURE

The present disclosure relates to tools and methods for installing fasteners into the wooden frame of a building. More particularly, this disclosure relates to a guide for precise installation of fasteners to secure the top plate to trusses or rafters.

The wooden frames of modern buildings must meet requirements set forth in local and state building codes based on codes such as the International Residential Code and the International Building Code. To satisfy bare minimum requirements of such building codes, the top plate and the rafters or trusses must resist substantial amounts of uplift force. In locations that experience increased wind uplift and/or seismic activity a stronger connection between the top plate and rafters or trusses is required.

Traditionally, a stronger connection between the top plate and rafters or trusses is accomplished using hurricane clips or other forms of metal straps or clips. Traditionally, hurricane clips are inefficient to install, as 8 or more nails or threaded fasteners are required to satisfy connection force requirements.

A secure and more time-efficient connection between the top plate and rafters or trusses can be made using a 6 inch threaded fastener such as the TimberLok® wood screw manufactured and marketed by OMG, Inc. of Agawam, Mass. To secure the components with the required amount of retention, the threaded fastener is driven through the top plate and into the rafters or trusses at a 22.5° (±5°) angle with respect to an axis defined by a structural member such as a vertical framing stud and/or top plate. Though securing a single fastener is quicker than attaching a hurricane clip, it is difficult to consistently estimate a precise 22.5° angle, and using a protractor and a level to install a threaded fastener can be just as difficult and time-consuming as conventional methods.

Accordingly, there is a need for an improved apparatus and method to secure a top plate and rafters or trusses by a threaded fastener having a consistently precise 22.5° angle ±5°.

DEFINITIONS

As used herein, the term "roof support member" means any framing component that provides structural support to a roof of a building, such as a rafter, a truss, or a horizontal ceiling joist.

As used herein, the term "top plate" means the horizontal framing component (which may include two or more members such as two 2×4-inch members) attached to the topmost end of the vertical structural members or "studs," and to which the roof support members are secured.

SUMMARY

Briefly stated, a fastener installation guide comprises a grip assembly and a fastener retention assembly. The fastener installation guide is configured to secure a top plate having a height h to a roof support member having a thickness t with a threaded fastener suitable for roofing, such as a lag screw.

The grip assembly of the present disclosure has first and second top plate alignment members oriented perpendicular to one another. The first top plate alignment member is configured to abut an upper surface of the top plate, while the second top plate alignment member is configured to abut a side surface of the top plate. A gripping surface extends between the first and second top plate alignment members. In one embodiment, the gripping surface is partially cylindrical and circumscribes the first and second top plate alignment members.

A roof support member alignment wall is located at a lateral end of the grip assembly adjacent the fastener alignment assembly. The roof support member alignment wall defines a first plane oriented transversely to the grip assembly. During installation, the roof support member alignment wall engages a face of the roof support member, and cooperates with the fastener retention assembly to align the fastener at a point of installation that provides an optimal anchor between the top plate and the roof support member.

The fastener retention assembly is oriented transversely to the grip assembly and has a fastener alignment wall, roof support member alignment edge and a bottom edge. The roof support member alignment edge and bottom edge are disposed at axially opposite ends of the fastener retention assembly.

The fastener retention assembly defines a fastener retention channel having a depth d and oriented at an angle θ with respect to the second plane. The dimensions d and θ may vary dependent upon the dimensions of the top plate and roof support member. In one embodiment, the depth d is preferably equal to one half the thickness t of the roof support member, a configuration which ensures the fastener is secured to the roof support member at a point which will provide a high integrity connection between the top plate and roof support member. The angle θ may vary between approximately 17.5° and approximately 27.5° with respect to the second plane, and is preferably oriented at 22.5°.

The fastener retention channel communicates with the fastener alignment wall at a point intermediate the roof support member alignment edge and the bottom edge. In one embodiment, the point of communication of the fastener retention channel is defined at a length l from the roof support member alignment edge, l being equal to a height h of the top plate.

To secure the top plate to the roof support member utilizing the fastener installation guide of the present disclosure, a fastener is placed in the retention channel, and the first and second top plate alignment members are oriented against upper and side surfaces of the top plate. With the grip assembly properly aligned on the top plate, the fastener alignment surface is placed against the side surface of the top plate. In areas where the top plate is secured adjacent a framing stud, the fastener alignment surface is also placed against a vertical surface of the stud. The roof support member alignment wall is subsequently aligned with a side surface of the roof support member, and the roof support member alignment edge engages a horizontal surface of the roof support member.

Once the fastener alignment guide is properly aligned, the fastener is driven partially through the alignment channel and into the top plate, such that a leading portion of the fastener is securely retained in the top plate. A length of the fastener greater than a total combined length of first and second portions of the fastener retention channel projects from the wood to ensure the fastener retention guide is not pinned to the top plate.

Once the fastener is partially driven into the top plate, the fastener installation guide is slid laterally along the top plate, removing the fastener from the fastener retention channel. After the fastener is clear of the retention channel, the fastener is driven through the top plate such that a head of the fastener is flush with the top plate, and the leading portion of the fastener secures the roof support member to the top plate.

The fastener installation guide and method of installation in the present disclosure simplify and accelerate construction of residential structures, by reducing installation-time of the connection between the top plate and roof support member. The method of securing the top plate to a roof support member using the fastener installation guide eliminates the need for hurricane ties, and provides a consistent secure connection without repeatedly utilizing a level and protractor. The configuration of the grip assembly, roof support member alignment wall and fastener retention assembly ensure that a fastener is quickly and consistently installed to securely fasten a top plate to a roof support member.

BRIEF DESCRIPTION OF THE DRAWINGS

Aspects of the preferred embodiment will be described in reference to the Drawing, wherein like numerals reflect like elements.

DETAILED DESCRIPTION

Embodiments of a fastener installation guide for providing a secure connection between a top plate and roof support members will now be described with reference to the drawings wherein like numerals represent like parts throughout FIGS. 1-9.

Figure 1:
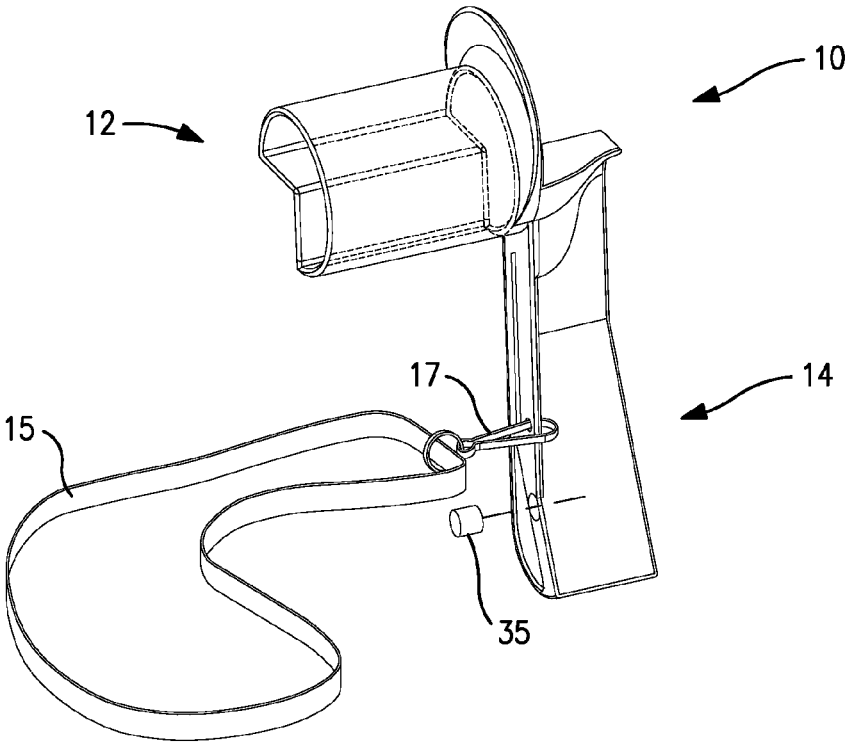
FIG. 1 shows a perspective, partially exploded view, partially in phantom, of one embodiment of a fastener installation guide.
Figure 2:
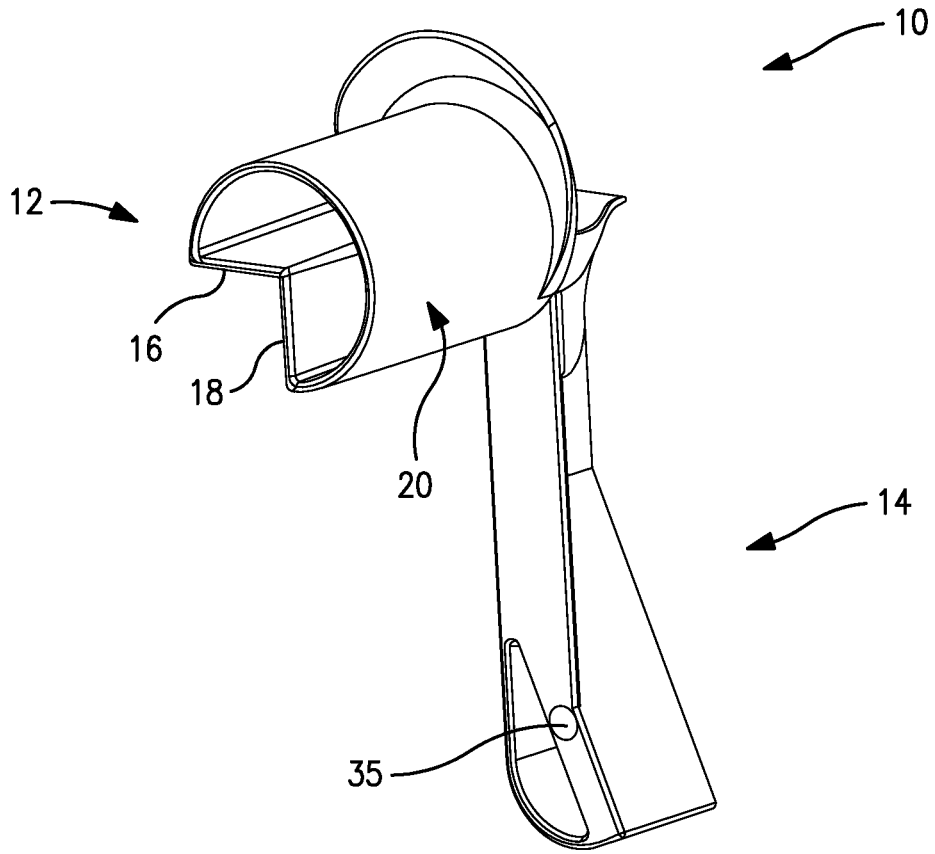
FIG. 2 shows a perspective view, partially in phantom, of another embodiment of a fastener installation guide.

FIG. 2 illustrates an embodiment of a fastener installation guide 10. The fastener installation guide 10 has a grip assembly 12 and a fastener retention assembly 14. The grip assembly 12 and the fastener retention assembly 14 are oriented generally transverse to one another. Though the guide 10 depicted in FIGS. 1-8 is designed for use by right-handed individuals, the guide 10 may easily be adapted for use by left-handed individuals by inverting the position of the grip assembly 12 as shown in the Figs. with respect to the fastener retention assembly 14.

In one embodiment depicted in FIG. 1, a strap 15 is selectively attachable to the fastener retention assembly 14, to prevent the guide 10 from falling and breaking during use. In the embodiment shown in FIG. 1, the strap 15 is a loop of woven nylon cord attached to the fastener retention assembly with a metal spring clip 17. Other configurations for the strap 15 and metal spring clip 17 may be used without departing from the scope of the disclosure.

In the embodiment depicted in FIG. 2, the grip assembly 12 has first and second top plate alignment members 16 and 18, respectively, and a gripping surface 20. The first and second top plate alignment members 16 and 18 are generally oriented perpendicular to one another. The gripping surface 20 extends between the first and second top plate alignment members 16 and 18. In the embodiment shown in FIGS. 1-2 and 8, the gripping surface is partially cylindrical in shape, and circumscribes the first and second top plate alignment members 16 and 18.

Figure 3:
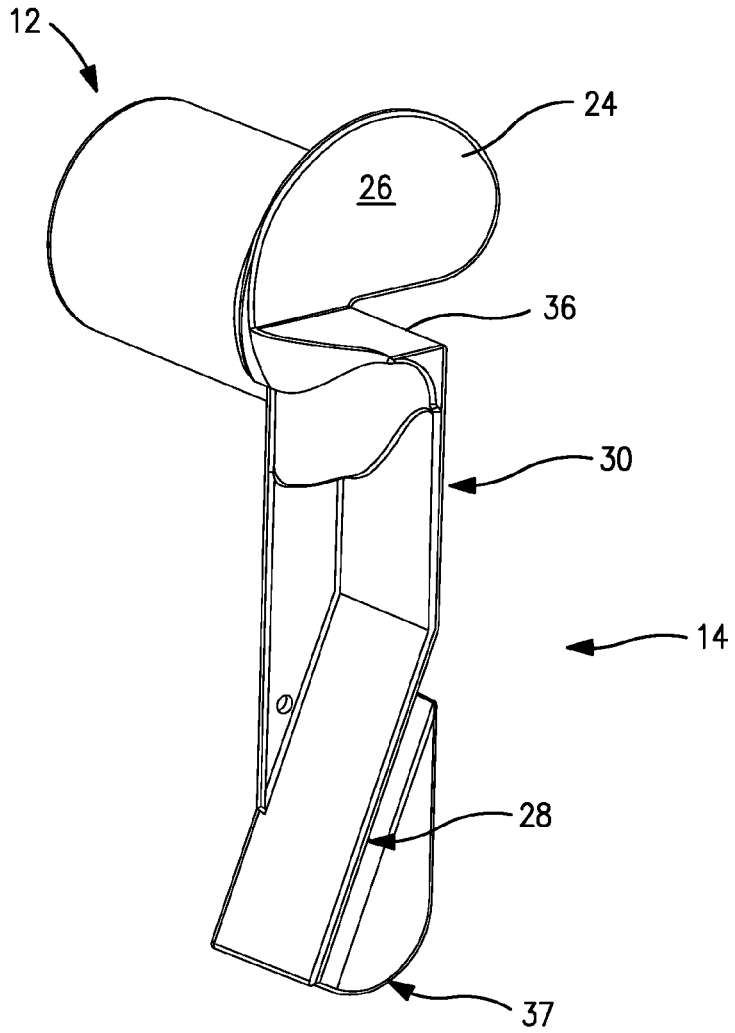
FIG. 3 shows an alternate perspective view, partially in phantom, of the fastener installation guide depicted in FIG. 2.

Referring to FIG. 3, a roof support member alignment wall 24 is located at a lateral end of the grip assembly 12. The roof support member alignment wall 24 defines a first plane $P_1$, oriented transverse to the grip assembly 12, and has a generally flat roof support member abutting surface 26 coplanar with $P_1$ (FIG. 4).

Figure 4:
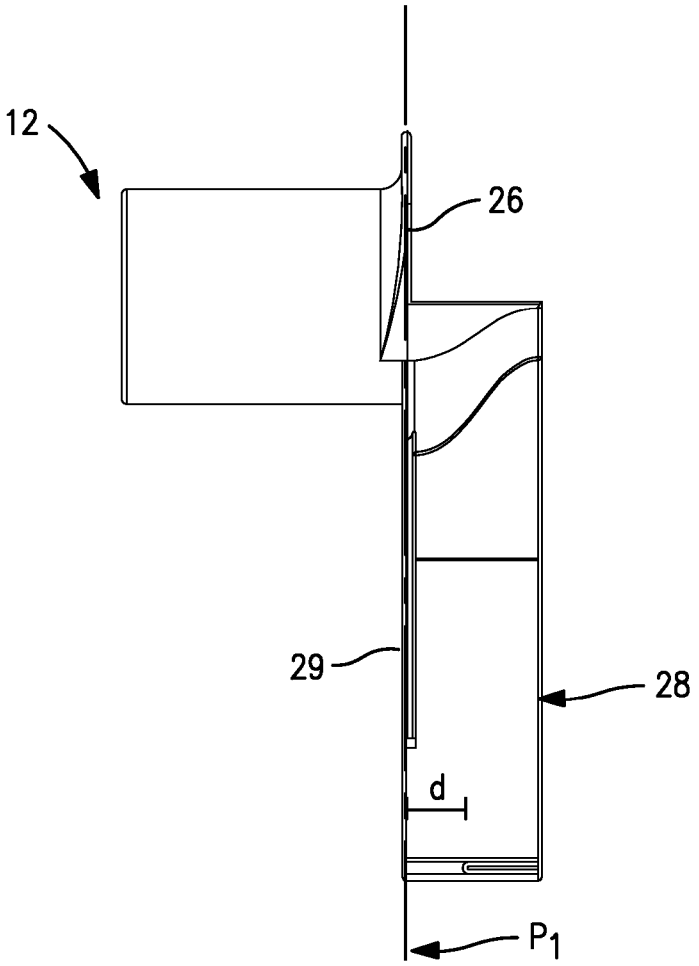
FIG. 4 shows a frontal view, partially in phantom, of the fastener installation guide depicted in FIG. 2.
Figure 5:
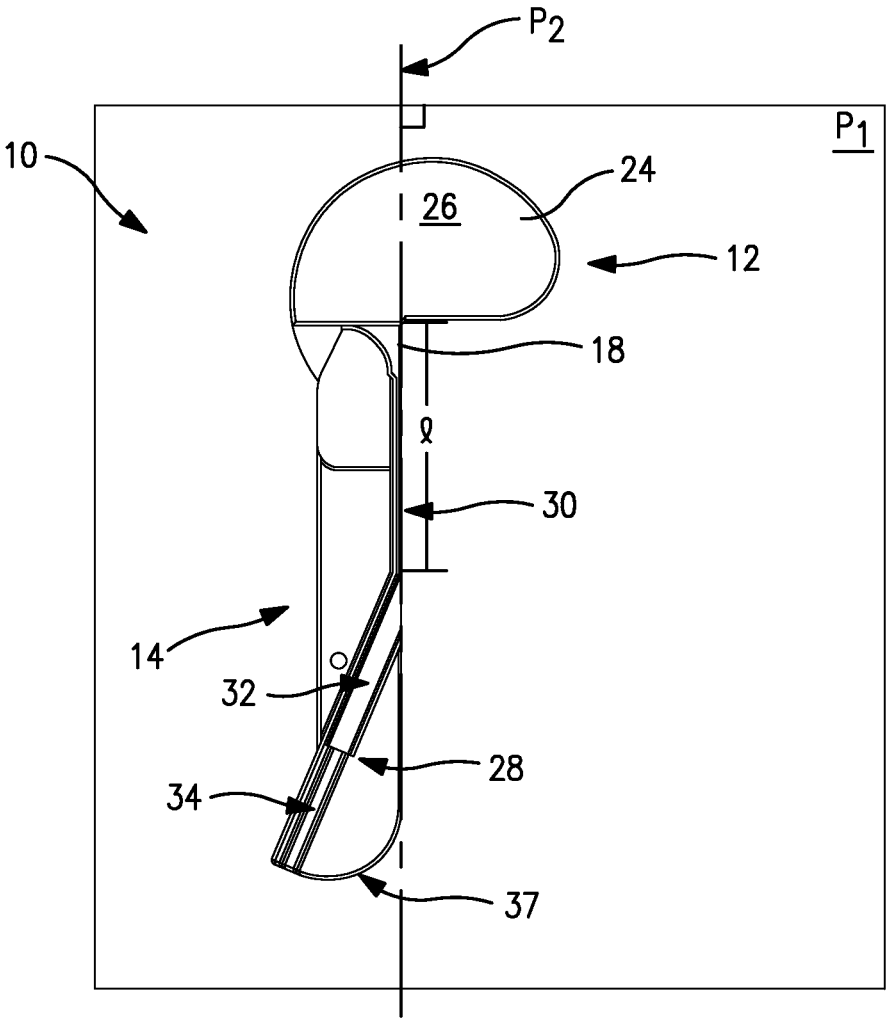
FIG. 5 shows a side view, partially in phantom, of the fastener installation guide depicted in FIG. 2.

As depicted in FIGS. 3-5, the fastener retention assembly 14 defines a fastener retention channel 28. In one embodiment, the fastener retention channel has first and second portions 32 and 34 and a depth d. As depicted in FIG. 4, the depth d of the retention channel 28 is measured from a lateral side 29 of the fastener retention assembly 14. As best seen in FIG. 4, the first plane $P_1$ is coplanar with the lateral side 29.

In the embodiment depicted in FIG. 5, the retention channel first portion 32 is generally thicker than the retention channel second portion 34. The dimensions of the first and second portions 32 and 34 ensure that the fastener retention channel 28 securely retains a fastener (not shown), such as a TimberLok® wood screw manufactured and marketed by OMG, Inc., of Agawam, Mass. Similar lag screw having a leading threaded length having a diameter slightly larger than a following unthreaded length may also be utilized.

In the embodiment depicted in FIG. 1, a magnet 35 is disposed adjacent the fastener retention channel 28 to securely retain a fastener (not shown) within the channel 28. While a threaded fastener is depicted as the fastener 38 in FIGS. 6, 7, and 8, other fasteners may be employed without departing from the scope of the disclosure.

Figure 6:
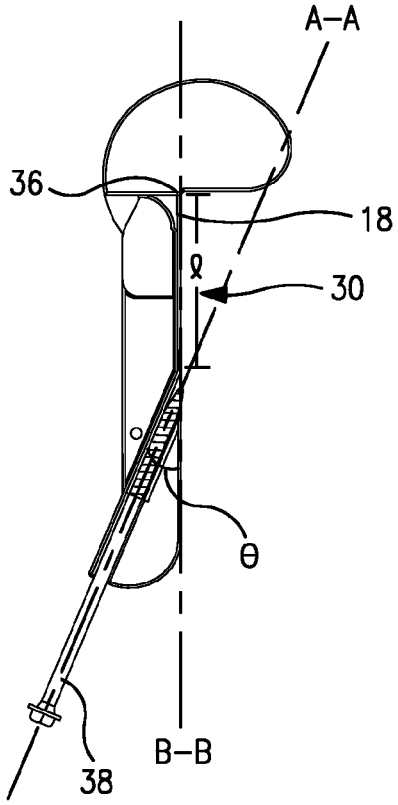
FIG. 6 shows the side view of the fastener installation guide depicted in FIG. 5, and including a threaded fastener secured within the installation guide.
Figure 7:
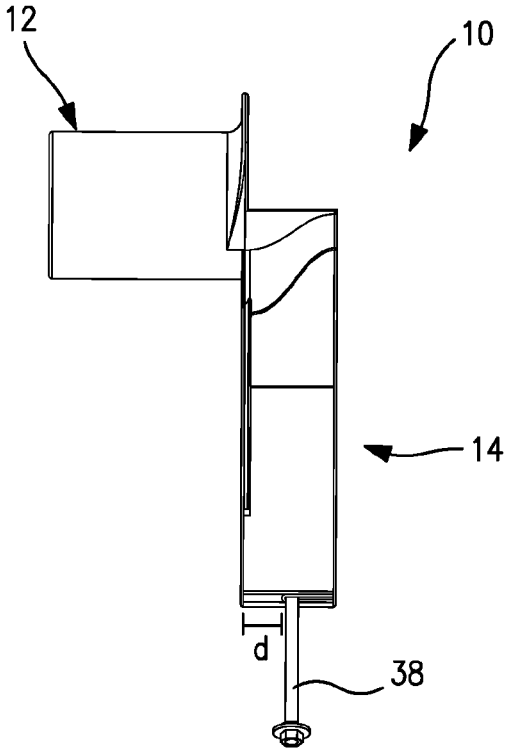
FIG. 7 shows a frontal view, partially in phantom, of the fastener installation guide and threaded fastener depicted in FIG. 6.

As depicted in FIGS. 5 and 6, the fastener retention assembly 14 has a fastener alignment wall 30 which defines a second plane $P_2$. In the embodiment shown in FIGS. 5 and 9, the top plate second alignment member 18 is coplanar with the second plane $P_2$, and $P_1$ and $P_2$ are oriented perpendicular to one another. The coplanar configuration of the fastener alignment wall 30 and top plate second alignment member 18 eliminates gaps between the fastener alignment wall 30 and a top plate 40 and/or stud 44, and ensures the fastener 38 is consistently installed at an angle θ (described in further detail below) which provides an optimal anchor between the top plate 40 and the roof support member 42.

At an end adjacent the roof support member alignment wall 24, the fastener alignment wall 30 terminates in a roof support member alignment edge 36. At an end axially opposite the roof support member alignment edge 36, the fastener alignment wall 30 terminates in a bottom edge 37. The roof support member alignment edge 36 is oriented generally perpendicular to the roof support member alignment wall 24. The first portion 32 of the fastener retention channel 28 communicates with the fastener alignment wall 30 at a point intermediate the roof support member alignment edge 36 and the bottom edge 37. The surface of the fastener alignment wall 30 coplanar with $P_2$ has a length l, measured between the roof support member alignment edge 36 and the first portion 32 of the fastener retention channel 28.

Referring to FIG. 6, the fastener installation guide is configured such that when the fastener 38 is installed in the fastener retention channel 28, an axis A-A defined by the fastener is oriented at an angle θ with respect to an axis B-B received in and coplanar with the plane $P_2$. In one embodiment, the angle θ is 22.5°. The angle θ can deviate ±5° from 22.5° and the guide will still ensure a secure connection between a top plate and a rafter that will meet regulations such as those set forth in the International Residential Code.

Figure 8:
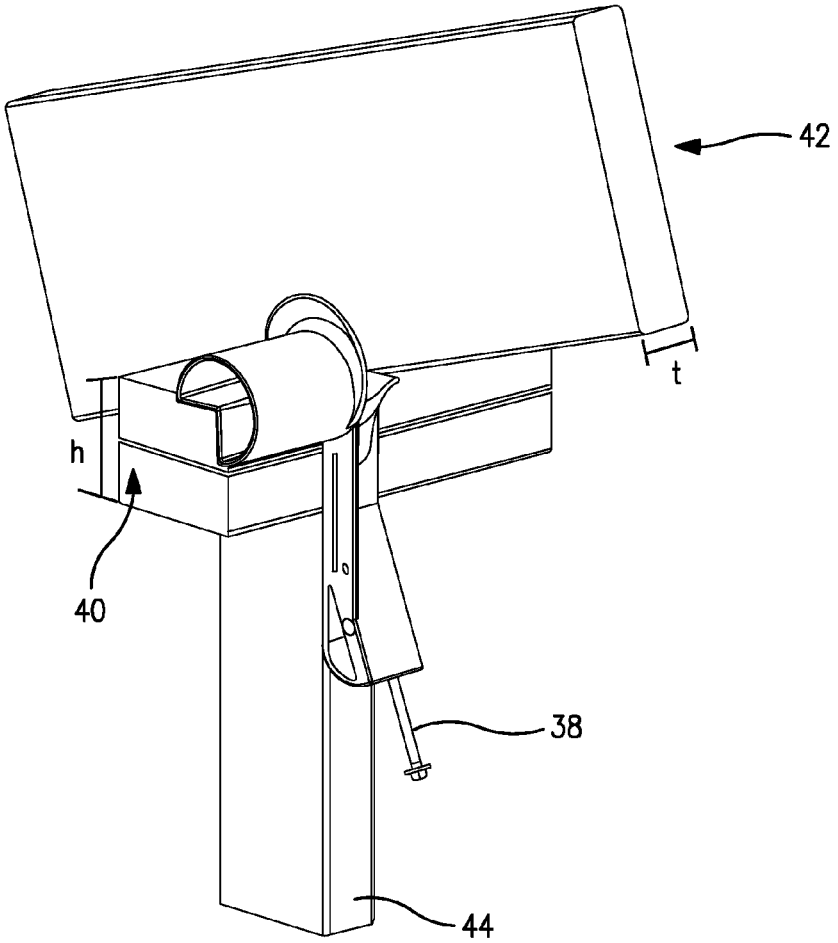
FIG. 8 shows a perspective functional view of the fastener installation guide and threaded fastener depicted in FIGS. 6 and 7, as employed for securing a top plate to a roof support member.
Figure 9:
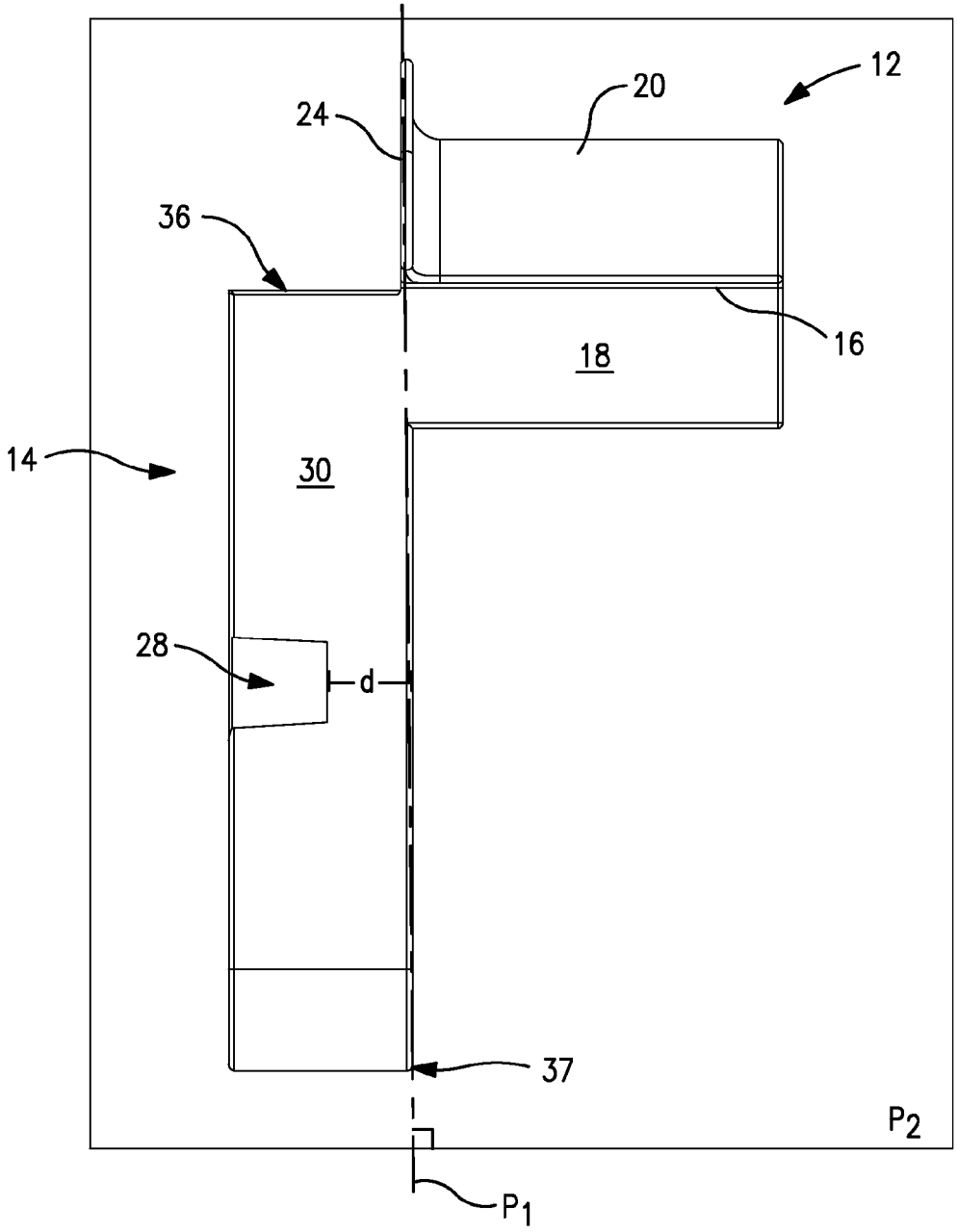
FIG. 9 shows a frontal view of the fastener installation guide of FIG. 2.

In the illustrated environment of FIG. 8, a representative top plate 40 and roof support member 42 are illustrated in conjunction with a stud 44. A representative top plate 40 has a height h, while the roof support member 42 has a thickness t. The height h of the top plate 40 and the thickness t of the roof support member 42 are generally uniform. In one embodiment of the guide 10 (FIG. 4), the depth d of the retention channel 28 is slightly less than one half the thickness t of the roof support member 42. Configuring the depth d to correspond to slightly less than one half the thickness t of the roof support member 42 ensures that the fastener 38 establishes a firm connection between the framing elements. In another embodiment of the guide 10, the height h of the top plate 40 (FIG. 8) is equal to the length l of the fastener alignment wall 30 (FIGS. 5 and 6).

To use the fastener alignment guide 10 to consistently install a fastener at an angle θ, a fastener 38 is first placed in the fastener retention channel 28. As shown in FIG. 8, the guide 10 is gripped and oriented on the top plate 40 such that the first and second top plate alignment members 16 and 18 and the fastener alignment wall 30 lie flat upon perpendicular portions of the top plate 40. Next, the guide 10 is laterally positioned until the roof support member alignment wall 24 lies flat against the roof support member 42. In one embodiment the fastener 38 is driven into the top plate 40 such that a substantial length of the threaded length of the fastener 38 is received in the top plate 40. The guide 10 is then removed from the framing components, and the fastener 38 is completely driven into the top plate, securing the roof support member 42 to the top plate 40.

While a preferred embodiment has been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

The invention claimed is:

1. A fastener installation guide for securing a top plate having a height h to a roof support member having a thickness t, the guide comprising:

a grip assembly having first and second top plate alignment members, said first and second top plate alignment members oriented generally perpendicular to one another, and a gripping surface extending between said first and second top plate alignment members;

a roof support member alignment wall defining a first plane oriented transverse to said grip assembly and located at a lateral end of said grip assembly; and a fastener retention assembly oriented transverse to said grip assembly and having a fastener alignment wall defining a second plane, a roof support member alignment edge and a bottom edge at axially opposite ends of said fastener retention assembly and defining a fastener retention channel, said fastener retention channel having a depth d and a fastener retention channel axis oriented at an angle θ with respect to said second plane;

wherein said roof support member alignment edge extends perpendicularly from said roof support member alignment wall and said fastener retention channel communicates with said fastener alignment wall at a point intermediate said roof support member alignment edge and said bottom edge.

2. The fastener installation guide of claim 1, wherein θ is an angle between 17.5 and 27.5°.

3. The fastener installation guide of claim 1, wherein θ is 22.5°.

4. The fastener installation guide of claim 1, wherein said gripping surface is partially cylindrical and circumscribes said first and second top plate alignment members.

5. The fastener installation guide of claim 1, wherein said depth d of said fastener retention channel is equal to one half the thickness t of the roof support member.

6. The fastener installation guide of claim 1, wherein a magnet is disposed adjacent said fastener retention channel.

7. The fastener installation guide of claim 1, wherein said fastener retention channel has a first portion communicating with said fastener alignment wall and a second portion communicating with said rounded edge.

8. The fastener installation guide of claim 5, wherein said fastener retention channel first portion is thicker than said fastener retention channel second portion, said fastener retention channel first and second portions sized such that a lag screw having a thicker threaded leading portion than an unthreaded following portion is securely retained within said fastener retention channel.

9. The fastener installation guide of claim 5, wherein a length l between said roof support member alignment edge and said fastener retention channel first portion is equal to the height h of the top plate.

10. The fastener installation guide of claim 1, wherein said first plane is oriented generally perpendicular to said second plane.

11. A method of securing a top plate having a height h to a roof support member having a thickness t, utilizing a fastener installation guide having a grip assembly, a fastener retention assembly having a fastener alignment surface and oriented transverse to the grip assembly, and a roof support member alignment wall disposed at a lateral end of said grip assembly, the method comprising:

placing a fastener in a fastener retention channel of the fastener retention assembly oriented at an angle θ with respect to the fastener alignment surface and communicating with a second plane defined by a fastener alignment wall of said fastener retention assembly;

orienting first and second perpendicularly oriented top plate alignment members of the grip assembly against a top plate upper surface and a top plate side surface such that said first and second top plate alignment walls engage against the upper and side surfaces;

positioning the fastener alignment surface against one of the side surface of the top plate, a vertical surface of a framing stud, or both;

aligning the roof support member alignment wall flush with a side surface of the roof support member;

driving said fastener partially through said fastener alignment channel such that a threaded portion of said fastener engages and securely retains said fastener within said top plate; and sliding said fastener installation guide laterally along said top plate such that said fastener is completely removed from said fastener retention channel, and driving said fastener through said top plate such that a head of said fastener is flush with the top plate and said threaded portion of said fastener secures the roof support member to the top plate.

12. The method of claim 11, wherein said fastener is placed within said fastener retention channel at a depth d equal to one half the thickness t of the roof support member.

13. The method of claim 11, wherein said fastener is placed in said fastener retention channel at a depth d within the effective range of a magnetic field emitted by a magnet disposed in the fastener retention assembly such that said magnetic field retains said fastener in said fastener retention channel.

14. The method of claim 11, aligning the roof support member alignment wall flush with a side surface of the roof support member further involves orienting a roof support member alignment edge located at an axial end of said fastener retention assembly adjacent said roof support member alignment wall against a bottom surface of the roof support member.

15. The method of claim 11, wherein a length of said fastener greater than a total combined length of first and second portions of said fastener retention channel projects from the top plate such that said fastener retention guide is not pinned to the top plate after said fastener is partially driven through said fastener retention channel.

* * * * *